US007849913B2

(12) United States Patent
Struensee

(10) Patent No.: US 7,849,913 B2
(45) Date of Patent: Dec. 14, 2010

(54) ROTATING HEAT EXCHANGER AND METHOD FOR SEALING THE SAME

(75) Inventor: Norbert Struensee, Essen (DE)

(73) Assignee: Klingenburg GmbH, Gladbeck (DE)

( * ) Notice: Subject to any disclaimer, the term of this patent is extended or adjusted under 35 U.S.C. 154(b) by 1077 days.

(21) Appl. No.: 10/555,402

(22) PCT Filed: May 19, 2004

(86) PCT No.: PCT/EP2004/005416

§ 371 (c)(1),
(2), (4) Date: Nov. 2, 2005

(87) PCT Pub. No.: WO2004/111563

PCT Pub. Date: Dec. 23, 2004

(65) Prior Publication Data

US 2006/0278364 A1 Dec. 14, 2006

(30) Foreign Application Priority Data

Jun. 13, 2003 (DE) ..... 103 27 078

(51) Int. Cl.
*F23L 15/02* (2006.01)
*F28D 17/00* (2006.01)

(52) U.S. Cl. ..... 165/9; 165/4

(58) Field of Classification Search ..... 165/6, 165/8, 9, 10, 281, 283, 284, 285; 277/304, 277/306

See application file for complete search history.

(56) References Cited

U.S. PATENT DOCUMENTS

| | | | | |
|---|---|---|---|---|
| 2,665,120 A * | 1/1954 | Blomquist | 165/7 |
| 2,977,096 A | 3/1961 | Evans | 165/7 |
| 3,122,200 A * | 2/1964 | Koch | 165/9 |
| 3,193,336 A * | 7/1965 | Moscardini | 384/321 |
| 3,880,225 A * | 4/1975 | Penny | 165/9 |
| 3,977,464 A | 8/1976 | Mai | 165/9 |
| 4,062,129 A | 12/1977 | Yoshida | 96/123 |
| 4,068,708 A | 1/1978 | Sakaki | 165/9 |
| 4,136,729 A * | 1/1979 | Sakaki | 165/9 |
| 4,542,782 A | 9/1985 | Berner | 165/9 |
| 5,577,551 A | 11/1996 | Kritzler | 165/9 |
| 6,004,384 A | 12/1999 | Caudle | 96/125 |

FOREIGN PATENT DOCUMENTS

DE 1085284 7/1960

(Continued)

OTHER PUBLICATIONS

US 5,996,683, 12/1999, Mori (withdrawn)

*Primary Examiner*—Tho v Duong
(74) *Attorney, Agent, or Firm*—Andrew Wilford

(57) ABSTRACT

The invention relates to a rotating heat exchanger (1) with a rotatably mounted rotor (3), comprising a first flow sector (4), for external (5) and supply air (6) and a second flow sector (7), for exhaust (8) and venting air (9), through which the above runs on rotating and a housing (2), enclosing the rotor (3) around the circumference thereof, whereby to improve the sealing of the rotor (3), the housing (2) around the circumference thereof is filled with housing or sealing air, whereby the pressure of the housing or sealing air is higher than the pressure of the airflows (5, 6; 8, 9) flowing through the rotor (3).

16 Claims, 2 Drawing Sheets

FOREIGN PATENT DOCUMENTS

| | | |
|---|---|---|
| DE | 1170106 | 4/1964 |
| DE | 2725190 | 12/1977 |
| EP | 0297230 | 1/1989 |
| GB | 1001235 | 8/1965 |
| JP | 53025958 | 3/1978 |
| JP | 17175694 | 10/1982 |

* cited by examiner

ROTATING HEAT EXCHANGER AND METHOD FOR SEALING THE SAME

CROSS REFERENCE TO RELATED APPLICATIONS

This application is the US national phase of PCT application PCT/EP2004/005416, filed 19 May 2004, published 23 Dec. 2004 as WO2004/111563, and claiming the priority of German patent application 10327078.7 itself filed 13 Jun. 2003, whose entire disclosures are herewith incorporated by reference.

FIELD OF THE INVENTION

The invention relates to a rotating heat exchanger with a rotatably mounted rotor having a first flow sector for external and supply air and a second flow sector for exhaust and venting air, through which air runs upon rotating, and a housing surrounding the rotor at its periphery, and to a method for the sealing of such a rotating heat exchanger. Thus external air is flows from the outside through the rotor in the first sector to a user and then exhaust air from the user flows back through the rotor in the second sector and is vented.

BACKGROUND OF THE INVENTION

With known rotating heat exchangers of this kind, peripheral seals are provided between the rotor and the housing enclosing it at the front end face of the rotor and at the rear end face of the rotor, by means of which peripheral seals the exit of air from the airflow flowing through the rotor into the housing is to be prevented. Since the rotor rotates with respect to the housing enclosing it, considerable leaks between the rotor on the one hand and the housing on the other hand always occur during the operation of a rotating heat exchanger of this kind, which can lead to air from the airflows flowing through the rotor exiting from the rotor. This can lead to the supply air for a room made available by the rotating heat exchanger becoming undesirably contaminated.

OBJECT OF THE INVENTION

The problem underlying the invention is to develop a rotating heat exchanger and a method for sealing one such rotating heat exchanger in such a way that such leaks in an undesired direction can no longer take place.

SUMMARY OF THE INVENTION

This problem is solved according to the invention by the fact that the housing enclosing the rotor at its periphery is filled with housing or sealing air, and that the pressure of the housing or sealing air is higher than the pressure of the airflow through the rotor. As a result of the pressurization of the housing with housing or sealing air under excess pressure, the is pressure level in the housing is always kept above the pressure level of the airflow flowing through the rotor of the rotating heat exchanger. It is thus possible to prevent external and supply air being mixed with exhaust and venting air through the housing.

Furthermore, in the case of the rotating heat exchanger according to the invention, peripheral seals can obviously also be provided, by means of which the housing or sealing airflow can be reduced. Such peripheral seals can be fixed in an advantageous way on the housing of the rotating heat exchanger.

The pressure of the housing or sealing air can be kept at a constant pressure level. It must be taken into account here that this constant pressure level lies above the pressure level of the airflow flowing through the rotor of the rotating heat exchanger.

Alternatively, it is possible to keep the pressure of the housing or sealing air above the pressure of the airflow flowing through the rotor by a constant differential pressure.

With this mode of procedure, the amount of housing or sealing air by means of which the housing must be pressurized can be optimized, whereby a sufficient excess pressure is always present inside the housing.

The excess pressure inside the housing can be produced to advantage by means of an external or internal pressure source.

According to an advantageous embodiment, the rotating heat exchanger according to the invention includes a control and regulating device, by means of which the operation of the pressure source can be controlled and regulated according to the signal of a pressure sensor measuring the pressure in the housing and/or a pressure sensor measuring the airflow flowing through the rotor. Accordingly, the pressure level of the housing or sealing air in the housing is controlled or regulated in dependence on the pressure level in the housing, which is based on a set-point pressure, and/or the pressure level of the airflow flowing through the rotor.

Especially in places of use and cases of application in which there are present in the exhaust or venting air charges and compositions which can give rise to a risk of explosion for example, it is advantageous for the housing to be pressurised with non-critical housing or sealing air, because then the critical contents of the exhaust or venting air can be diluted, so that the explosion protection can be dispensed with, for example, in the combustion areas for driving motors.

According to an advantageous embodiment of the rotating heat exchanger according to the invention, airflow separation devices are provided running diametrically at the end faces of the rotor between the two flow sectors, said airflow separation devices being connected to the housing and able to be supplied with a sealing airflow by means of the housing or sealing air present in the housing. A fan, which is otherwise required for the airflow separation devices, can be dispensed with in the case of the rotating heat exchanger according to the invention. If a purging wedge-like device, which is connected to the housing and able to be supplied with a purging airflow by means of the housing or sealing air present in the housing, is provided at the end face of the rotor in the region of the flow sector for the exhaust and venting air that is arranged—in the rotary direction of the rotor—directly before the flow sector for external and supply air, it is also possible to dispense with a separate fan for supplying the purging wedge-like device. If the rotating heat exchanger according to the invention is provided according to an advantageous development with a temperature-regulating device, by means of which the housing or sealing air can, e.g. for the purpose of anti-icing, be temperature-regulated, any icing on the peripheral seals can be prevented, whereby the formation of condensate in the housing can also be eliminated. The housing or sealing air can be taken in a straightforward manner from the supply and/or external air system of the rotating heat exchanger.

To advantage, nozzles are provided on the housing of the rotating heat exchanger according to the invention, through which nozzles housing or sealing air can be directed onto a bearing of the rotor. As a result, the bearing of the rotor can be kept dry with relatively little outlay.

BRIEF DESCRIPTION OF THE DRAWING

The invention will be explained below in greater detail with the aid of an embodiment, reference being made to the drawing. In the figures.

SPECIFIC DESCRIPTION

Figure 1:
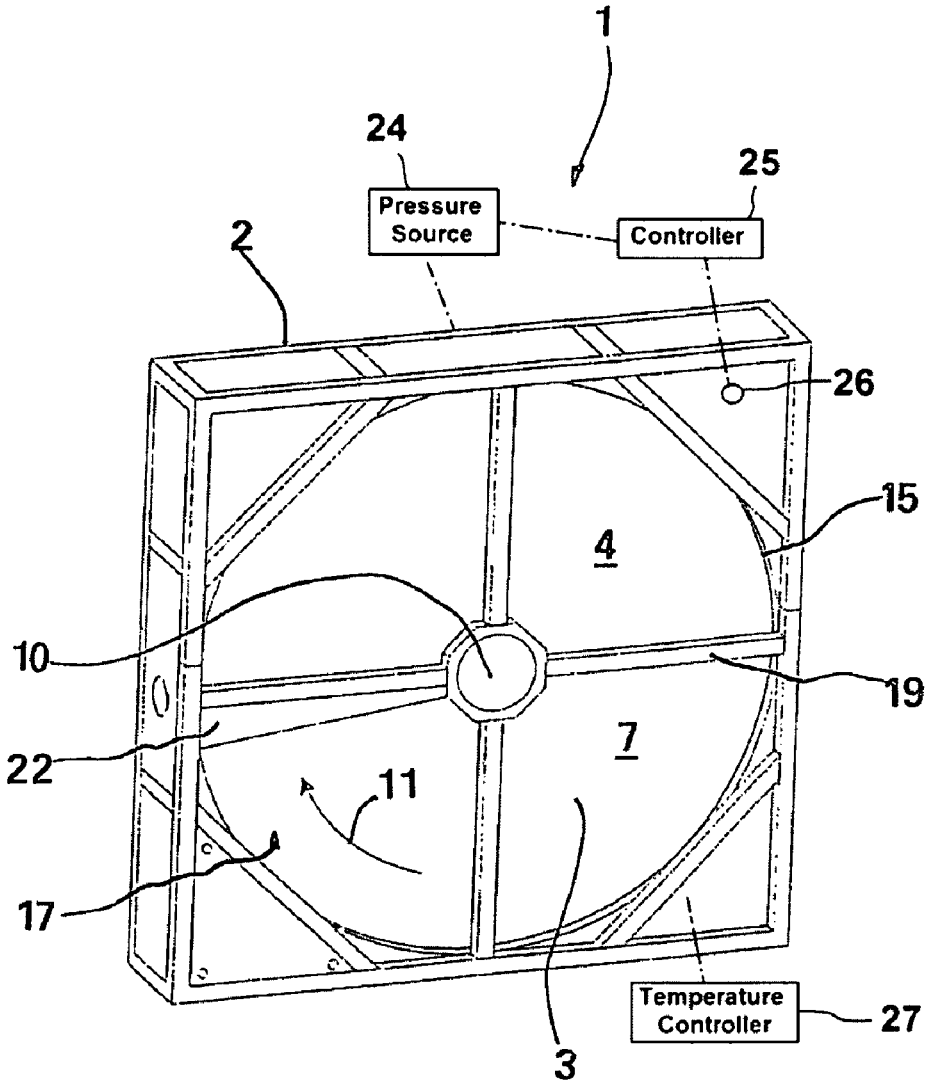
FIG. 1 shows a view of a rotating heat exchanger designed according to the invention.

A rotating heat exchanger 1 according to the invention shown in perspective view in FIG. 1 has a housing 2 approximately square in terms of its external contour in the embodiment shown.

Housing 2 encloses a rotor 3 of rotating heat is exchanger 1 at the periphery of the former.

Figure 2:
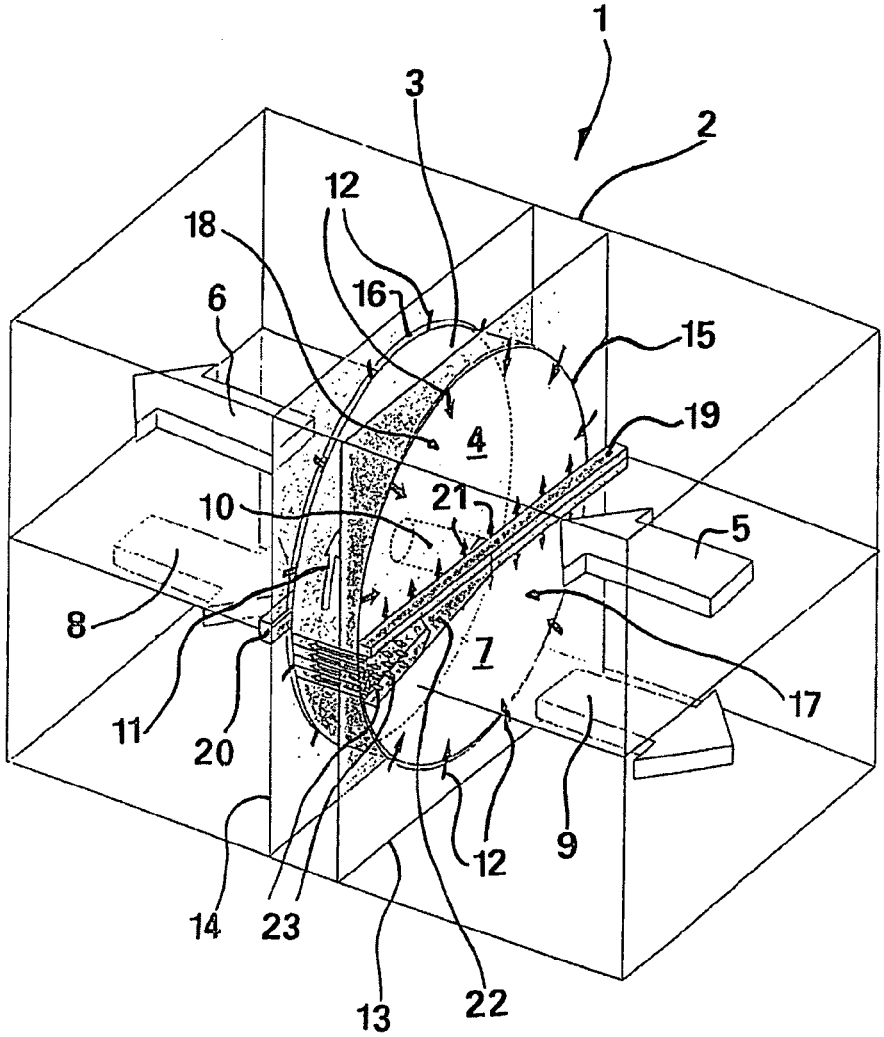
FIG. 2 shows a schematic representation of airflows through a rotor of the heat exchanger according to the invention and of sealing and purging airflows with a rotating heat exchanger designed according to the invention.

Rotor 3 has a first flow sector 4 through which external air 5 and supply air 6 flows, as can be seen from FIG. 2. The airflow for external air 5 and supply air 6 is represented by arrows in FIG. 2.

Furthermore, rotor 3 has a second flow sector 7, through which exhaust air 8 and venting air 9 flows in the opposite direction to external air 5 and supply air 6. The airflow formed by exhaust air 8 and venting air 9 is also shown by arrows in FIG. 2.

Rotor 3 of the rotating heat exchanger is arranged so as to be rotatable about a bearing or a hub 10. The direction of rotation of rotor 3 is shown by arrow 11 in FIG. 1 and FIG. 2.

Housing 2 is connected to a pressure source 24 by means of which it is pressurised with housing or sealing air, and more precisely at a pressure that is higher than the pressure level in airflows 5, 6; 8, 9 flowing through rotor 3. As a result, radial outflow of exhaust air 8 or venting air 9 from rotor 3 is prevented. Correspondingly, radial inflow of external air 5 and supply air 6 from rotor 3 is also prevented. Sealing airflow 12 represented by arrows and running radially inward with respect to rotor 3 enters into the airflow formed by external air 5 and supply air 6 and the airflow formed by exhaust air 8 and venting air 9. A controlled chamber air seal for rotating heat exchanger 1 is created, as it were, by housing 2 which is under excess pressure.

Peripheral seals 15, 16 are provided respectively between the periphery of rotor 3 and front wall 13 of housing 2 enclosing rotor 3 and correspondingly provided rear wall 14 of housing 2, by means of which peripheral seals leakage between is housing 2 on the one hand and rotor 3 on the other hand, which necessarily occur during the operation of rotating heat exchanger 1, are to be the kept as small as possible.

These peripheral seals 15, 16 are expediently fixed at front wall 13 and at rear wall 14 of housing 2, so that the external periphery of rotor 3 moves with respect to these peripheral seals 15, 16.

The pressure of the housing or sealing air inside housing 2 is either kept at a constant pressure level, whereby this pressure level is selected in such a way that it is always above the pressure level of airflows 5, 6; 8, 9 flowing through rotor 3. Alternatively, it is possible to control and regulate the pressure of the housing or sealing air inside housing 2 in such a way that this pressure always lies above the pressure level in airflows 5, 6; 8, 9 flowing through rotor 3 by a predeterminable differential pressure.

An external or an internal pressure source such as shown schematically at 24 in FIG. 1 can be provided as a pressure source.

By means of a control and regulating device shown schematically at 25 in the figures, which includes a pressure sensors 26 (only one shown) arranged in housing 2 and a pressure sensor detecting the pressure in external air 5 and supply air 6 and in exhaust air 8 and venting air 9. The pressure inside housing 2 is controlled or regulated according to the signals of these pressure sensors 26. A set-point pressure inside housing 2 or a differential pressure between the pressure in housing 2 and the pressure inside airflows 5, 6; 8, 9 can be used as a target magnitude.

If at least one airflow that is critical from the composition standpoint flows through rotor 3 of rotating heat exchanger 1, the housing 2 needs to be pressurized with non-critical housing or sealing air. Said critical airflow can be diluted by means of this non-critical housing or sealing air, in such a way that the risks resulting from the composition of the critical airflow, e.g. risk of explosion, are reduced.

An airflow separation device 19 and 20 extending horizontally and diametrically over rotor 3 is provided respectively at two end faces 17, 18 of rotor 3. The two airflow separation devices 19, 20 are designed, as it were, as central crosspieces, the interior space whereof communicates with the interior space of housing 2, so that the two airflow separation devices 19, 20 are pressurized by the source 24 with housing or sealing air under excess pressure. There emerges from the two airflow separation devices 19, 20 a sealing airflow shown by arrows 21, by means of which mixing of external air 5 and venting air 9 is prevented at end face 17 of the rotor and mixing of supply air 6 and exhaust air 8 is prevented at end face 18 of rotor 3.

Furthermore, a purging wedge-like device 22 is arranged at end face 17 of rotor 3 beneath airflow separation device 19. The purging wedge-like device directs a purging airflow shown by arrows 23 through rotating rotor 3, so that co-rotating air from second flow sector 7, which is assigned to exhaust air 8 and venting air 9, is prevented from passing into first flow sector 4 of rotor 3, which is assigned to external air 5 and supply air 6. With the rotating heat exchanger shown in FIGS. 1 and 2, purging wedge-like device 22 is connected—like the two airflow separation devices 19, 20—to housing 2, so that purging airflow 23 is also fed through housing or sealing air from housing 2.

Furthermore, rotating heat exchanger 1 shown in FIGS. 1 and 2 is equipped with a heating device not shown in the figures, by means of which the housing or sealing air can be heated. In the case of certain requirements, however, it may also be expedient generally to provide a temperature-regulating device or controller 27 by means of which the temperature of the housing or sealing air inside housing 2 can be temperature-regulated at will. The aforementioned heating device is especially expedient when icing of rotating heat exchanger 1 is to be prevented in the presence of certain temperature conditions.

The housing or sealing air can be taken from the supply air system or the external air system of rotating heat exchanger 1.

Housing 2 can be provided with nozzles, not shown in FIGS. 1 and 2, through which bearing or hub 10 of rotor 3 of rotating heat exchanger 1 can be kept dry. This is of special importance particularly in the case of rotating heat exchangers 1 in which airflows 5, 6; 8, 9 flowing through rotor 3 are subjected to humidity.

The invention claimed is:

1. A rotating regenerative heat exchanger comprising:

a heat-exchange rotor rotatable about an axis and having axially oppositely directed front and rear end faces and an outer periphery;

a housing surrounding the rotor and defining a first flow sector for axial front-to-rear flow through the rotor of air from the exterior and, angularly offset from the first sector a second flow sector for axial rear-to-front flow through the rotor of air to the exterior;

means for pressurizing the housing around the periphery of the rotor with housing air;

front and rear separators fixed in the housing, juxtaposed with the respective end faces of the rotor, and extending diametrically of the rotor between the sectors;

means for projecting sealing air from the separators and thereby preventing mixing of air between the sectors; and a purging wedge-like device connected to the housing and able to be supplied with a purging airflow from the means for pressurizing at the end face of the rotor in the region of the first flow sector and immediately upstream in a rotation direction of the rotor of the second flow sector.

2. The rotating heat exchanger according to claim 1, further comprising peripheral seals between the periphery of the rotor on the one hand and the housing on the other hand.

3. The rotating heat exchanger according to claim 2, wherein the peripheral seals are fixed to the housing.

4. The rotating heat exchanger according to claim 1 wherein the means for pressurizing maintains pressure of the housing or sealing air at a constant pressure level.

5. The rotating heat exchanger according to claim 1 wherein the means for pressurizing maintains pressure of the housing or sealing air at a constant differential pressure above the pressure of the airflows flowing through the rotor.

6. The rotating heat exchanger according to claim 1, further comprising a control and regulating device for operating the pressure source according to an output signal of a pressure sensor measuring the pressure in the housing or a pressure sensor measuring the pressure of the airflows flowing through the rotor.

7. The rotating heat exchanger according to claim 1 wherein the means for pressurizing pressurizes the housing with non-critical housing or sealing air.

8. The rotating heat exchanger according to claim 1, further comprising a temperature-regulating device by means of which the housing or sealing air can be temperature-regulated.

9. The rotating heat exchanger according to claim 1 wherein the pressurizing means draws housing or sealing air from the airflow of the first sector.

10. A method of operating a regenerative heat exchanger having:

a heat-exchange rotor rotatable about an axis and having axially oppositely directed front and rear end faces and an outer periphery;

a wedge-like purging device on the rotor;

a housing surrounding the rotor and defining a first flow sector and, angularly offset from the first sector a second flow sector; and front and rear separators fixed in the housing, juxtaposed with the respective end faces of the rotor, and extending diametrically of the rotor between the sectors, the method comprising the steps of:

flowing air from the exterior axially front-to-rear through the first sector of the rotor;

flowing air to the exterior axially axial rear-to-front through the second sector of the rotor of air;

pressurizing the housing around the periphery of the rotor with housing air;

projecting sealing air from the separators and thereby preventing mixing of air between the sectors; and supplying housing or sealing air to the wedge-like device of the rotor from the housing as purging air.

11. The method according to claim 10 wherein the pressure level of the housing or sealing air in the housing is kept constant.

12. The method according to claim 10 wherein the pressure level of the housing or sealing air in the housing is kept above the pressure level of the airflows flowing through the rotor by a constant differential pressure.

13. The method according to claim 10 wherein the pressure level of the housing or sealing air in the housing is controlled or regulated in dependence on the pressure level in the housing or the pressure level of the airflows flowing through the rotor.

14. The method according to claim 10 wherein the housing is pressurized with noncritical housing or sealing air.

15. The method according to claim 10 wherein the housing or sealing air is temperature-regulated.

16. The method according to claim 10 wherein the housing or sealing air is taken from the supply air and/or external air system of the rotating heat exchanger.

* * * * *